US011545764B2

(12) United States Patent
Meyer et al.

(10) Patent No.: US 11,545,764 B2
(45) Date of Patent: Jan. 3, 2023

(54) SPRING-LOADED TERMINAL CONNECTION

(71) Applicant: WAGO Verwaltungsgesellschaft mbH, Minden (DE)

(72) Inventors: Michael Meyer, Wiedensahl (DE); Alexander Volkmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 89 days.

(21) Appl. No.: 17/176,811

(22) Filed: Feb. 16, 2021

(65) Prior Publication Data

US 2021/0257750 A1 Aug. 19, 2021

(30) Foreign Application Priority Data

Feb. 17, 2020 (DE) ..... 10 2020 104 077.6

(51) Int. Cl.
*H01R 4/48* (2006.01)
*H01R 4/26* (2006.01)
*H01R 43/16* (2006.01)

(52) U.S. Cl.
CPC ..... *H01R 4/4818* (2013.01); *H01R 4/26* (2013.01); *H01R 43/16* (2013.01)

(58) Field of Classification Search
CPC ..... H01R 4/26; H01R 4/4818; H01R 43/16
USPC ..... 439/436
See application file for complete search history.

(56) References Cited

U.S. PATENT DOCUMENTS

| | | | | |
|---|---|---|---|---|
| 8,292,677 | B2 * | 10/2012 | Gassauer | H01R 4/4836 439/729 |
| 9,502,790 | B2 * | 11/2016 | Kollmann | H01R 4/4836 |
| 9,614,301 | B2 * | 4/2017 | Ludewig | H01R 9/223 |
| 9,761,964 | B2 | 9/2017 | Meyer | |
| 10,033,119 | B2 * | 7/2018 | Koellmann | H01R 4/52 |
| 10,236,597 | B2 * | 3/2019 | Meyer | H01R 4/4809 |
| 10,367,272 | B2 * | 7/2019 | Witte | H01R 4/4845 |
| 10,367,276 | B2 * | 7/2019 | Wu | H01R 9/2416 |
| 10,418,727 | B1 * | 9/2019 | Wu | H01R 4/4827 |
| 10,461,444 | B2 * | 10/2019 | Scanzillo | H01R 13/502 |
| 2003/0194918 | A1 * | 10/2003 | Fricke | H01R 4/4827 439/835 |
| 2018/0323522 | A1 * | 11/2018 | Wu | H01R 9/26 |
| 2019/0131724 | A1 * | 5/2019 | Koellmann | H01R 9/2408 |
| 2019/0190168 | A1 * | 6/2019 | Witte | H01R 4/4845 |

FOREIGN PATENT DOCUMENTS

| | | | | |
|---|---|---|---|---|
| CN | 105144487 | A * | 12/2015 | H01R 4/4818 |
| DE | 4016770 | A1 | 11/1991 | |
| DE | 202005018168 | U1 | 1/2006 | |
| DE | 202013001487 | U1 | 3/2013 | |
| DE | 102013101830 | A1 * | 7/2014 | H01R 13/506 |

(Continued)

*Primary Examiner* — Peter G Leigh
(74) *Attorney, Agent, or Firm* — Muncy, Geissler, Olds & Lowe, P.C.

(57) ABSTRACT

A spring-loaded terminal connection having a busbar and a clamping spring, which has a clamping arm, wherein the clamping arm extends towards the busbar and has a spring clamping edge for clamping an electrical conductor and wherein the busbar has a busbar clamping edge for fixing the electrical conductor to be clamped, wherein the busbar clamping edge has a radius less than or equal to 0.2 mm.

19 Claims, 6 Drawing Sheets

(56) References Cited

FOREIGN PATENT DOCUMENTS

| | | | | | |
|---|---|---|---|---|---|
| DE | 202013101751 | U1 | | 7/2014 | |
| DE | 102013101406 | A1 | * | 8/2014 | ..... H01R 13/6275 |
| DE | 202013101751 | U1 | * | 9/2014 | ..... H01R 4/4818 |
| DE | 102013104394 | A1 | * | 10/2014 | ..... H01R 13/506 |
| DE | 102014102517 | A1 | | 8/2015 | |
| DE | 102014119421 | A1 | | 6/2016 | |
| DE | 102015104625 | A1 | * | 9/2016 | ..... H01R 4/4845 |
| DE | 102016105192 | B3 | * | 7/2017 | |
| DE | 102016105192 | B3 | | 7/2017 | |
| DE | 202016104374 | U1 | | 11/2017 | |
| DE | 102016111627 | A1 | * | 12/2017 | ..... H01R 4/4836 |
| EP | 2605335 | A2 | * | 6/2013 | ..... H01R 13/42 |
| EP | 2989685 | B1 | * | 9/2019 | ..... H01R 4/4818 |
| EP | 3866265 | A1 | * | 8/2021 | ..... H01R 4/26 |
| WO | WO-2014124959 | A1 | * | 8/2014 | ..... H01R 13/50 |
| WO | WO-2014173717 | A1 | * | 10/2014 | ..... H01R 4/4818 |
| WO | WO-2017081001 | A1 | * | 5/2017 | ..... H01R 4/48 |
| WO | WO-2017182647 | A1 | * | 10/2017 | ..... H01R 12/585 |
| WO | WO-2017220490 | A1 | * | 12/2017 | ..... H01R 4/4836 |
| WO | WO-2019192911 | A1 | * | 10/2019 | ..... H01R 4/4836 |

* cited by examiner

SPRING-LOADED TERMINAL CONNECTION

This nonprovisional application claims priority under 35 U.S.C. § 119(a) to German Patent Application No. 10 2020 104 077.6, which was filed in Germany on Feb. 17, 2020 and which is herein incorporated by reference.

BACKGROUND OF THE INVENTION

Field of the Invention

The present invention relates to a spring-loaded terminal connection having a busbar and a clamping spring, which has a clamping arm, wherein the clamping arm extends towards the busbar and has a spring clamping edge for clamping an electrical conductor and wherein the busbar has a busbar clamping edge for fixing the electrical conductor to be clamped. Further, the invention relates to a method for producing a spring-loaded terminal connection of this kind.

Description of the Background Art

DE 10 2014 102 517 A1, which corresponds to U.S. Pat. No. 9,761,964, which is herein incorporated by reference, discloses a spring-loaded terminal contact for contacting electrical conductors. The spring-loaded terminal contact has a clamping spring with a spring clamping edge and a busbar with a clamping edge, wherein the clamping edge and the spring clamping edge form a clamping location for the electrical conductor.

SUMMARY OF THE INVENTION

It is therefore an object of the present invention to create an improved spring-loaded terminal connection.

In the case of the spring-loaded terminal connection of the generic type, it is proposed that the busbar clamping edge have a radius less than or equal to 0.2 mm. It is advantageous further if the busbar clamping edge has a radius less than or equal to 0.1 mm.

By forming a busbar clamping edge with a very small radius, a spring-loaded terminal connection is provided which has a large conductor retention force. Particularly in the case of fine-stranded conductors and/or multi-core conductors, large conductor retention forces are necessary so that the electrical conductor to be clamped is securely held in the spring-loaded terminal connection. In the case of multi-core conductors, the problem can arise that only the outer cores of the conductor are exposed to a retention force due to the action of the spring clamping edge. It is possible that this retention force is not sufficient to securely clamp such multi-core conductors if, for example, a tensile force acts on these conductors. In addition, the conductors can also be damaged as a result in that the outer cores are pulled out of the conductor by the retention force.

A busbar clamping edge increases the retention force of the spring-loaded terminal connection because the electrical conductor to be clamped also experiences an additional retention force from the busbar clamping edge in addition to the spring clamping edge. The retention force of the busbar clamping edge can be further increased in that the radius of the busbar clamping edge is less than or equal to 0.2 mm, in particular less than or equal to 0.1 mm. By forming a small radius of the busbar clamping edge, the busbar clamping edge is formed sharp. Sharp means that the busbar clamping edge can cut into the electrical conductor to be clamped and the busbar clamping edge thus digs into the electrical conductor to be clamped. A greater retention force can be applied thereby to the electrical conductor to be clamped, which ensures a secure fixation of the conductor in the spring-loaded terminal connection. Furthermore, it can also be achieved with multi-core conductors that the outer cores can be subjected to an increased retention force on two opposite sides of the multi-core conductor. This ensures an overall greater retention force than if the spring clamping edge digs into the cores of the multi-core electrical conductor.

It is conceivable that the busbar clamping edge also has a smaller radius such as, for example, less than or equal to 0.075 mm, less than or equal to 0.05 mm, less than or equal to 0.025 mm, or less or equal to 0.01 mm. By reducing the radius, a sharper busbar clamping edge can be provided, which can more easily cut into the electrical conductor to be clamped and thus dig deeper into this conductor.

The clamping spring can have a contact arm and a spring bend located between the contact arm and the clamping arm.

Such a spring-loaded terminal connection does not necessarily need to have a busbar clamping edge with a radius less than or equal to 0.2 mm. Thus, it is also conceivable that a following spring-loaded terminal connection is provided:

A spring-loaded terminal connection having a busbar and a clamping spring, which has a clamping arm, wherein the clamping arm extends towards the busbar and has a spring clamping edge for clamping an electrical conductor and wherein the busbar has a busbar clamping edge for fixing the electrical conductor to be clamped.

The busbar clamping edge can have an asymmetrical contour with respect to a plane of symmetry, wherein the plane of symmetry extends through the busbar clamping edge orthogonally to the busbar. In this regard, the busbar clamping edge can form a barb for the electrical conductor to be clamped or have a barb-like effect with regard to the electrical conductor to be clamped.

The busbar clamping edge can be designed such that when the electrical conductor to be clamped is pulled, the busbar clamping edge cuts into the electrical conductor to be clamped. This can be done, for example, by forming the aforementioned barb. The barb is a hook, which is attached to the busbar facing backwards and thus prevents the electrical conductor to be clamped from moving backwards when inserted and thus being pulled out of the spring-loaded terminal connection. Facing backwards means that the radius of the busbar clamping edge is oriented in the direction of a conductor insertion direction of the electrical conductor to be clamped, so that when the conductor is pulled against the conductor insertion direction, the busbar clamping edge digs into the material of the conductor and fixes it in the spring-loaded terminal connection. However, a barb does not mean that a corresponding connection between the busbar clamping edge and the electrical conductor to be clamped can no longer be released. For example, the clamping arm of the clamping spring can be displaced by an actuating element, such as, for example, an actuating lever or an actuating tool or a screwdriver, and the clamping connection with the electrical conductor can thus be released.

A large retention force of the spring-loaded terminal connection on the electrical conductor to be clamped can be achieved in this way. The retention forces define a force that must be applied to release the electrical conductor from the clamping point by pulling against the conductor insertion direction.

The busbar clamping edge can be arranged across the width of the busbar transversely to the electrical conductor to be clamped.

By arranging the busbar clamping edge across the width of the busbar, a busbar clamping edge can be provided which can dig into the electrical conductor to be clamped over a correspondingly great length. This increases the contact area on the electrical conductor to be clamped, wherein the retention force can also be transferred evenly to the electrical conductor to be clamped, and the fixation of the conductor is thus further improved.

The busbar clamping edge in this case can extend over part of the width of the busbar, wherein the other part forms at least one busbar web. By forming a busbar web, the stability of the busbar and the flow of current through the busbar can be ensured. Because the busbar clamping edge can reduce the stability and the flow of current, it has been found that the busbar clamping edge cannot be formed over the full width of the busbar, but only over part of the width of the busbar. As a result, a sufficiently large contact surface can continue to be provided on the electrical conductor to be clamped, wherein at the same time the current flow through the busbar and the stability of the busbar are ensured. Conversely, however, this does not mean that the stability and the current flow through the busbar are insufficient if the busbar clamping edge is formed over the entire width of the busbar.

The busbar clamping edge can be located on a busbar clamping section which has been cut or punched out of the busbar. It is advantageous further if the busbar clamping section is located on the busbar in front of the busbar clamping edge in the direction of a conductor insertion direction.

The busbar clamping section is a section that is protruded from the busbar, for example, by punching out or free cutting, wherein the busbar clamping edge is located on this busbar clamping section.

The busbar can have a tab for fastening the clamping spring, wherein the clamping spring can be inserted into the tab in a self-supporting manner. This has the advantage that the clamping spring can be fastened to the busbar without additional fastening means.

The busbar can have a recess, wherein the recess is designed to receive the spring clamping edge. It is advantageous further if the recess is located in front of the busbar clamping edge in the conductor insertion direction.

A receptacle for the spring clamping edge can be created by the recess, so that the clamping spring is additionally stabilized when the electrical conductor to be clamped is not inserted. In this way, the transport safety of the spring-loaded terminal connection can be increased, so that the spring-loaded terminal connection can be safely transported in a preassembled state.

A depression can be located in the area of the busbar clamping edge. It is advantageous further if the depression is located behind the busbar clamping edge in the conductor insertion direction. As a result of the depression, a busbar clamping edge can be created at a sufficient height in relation to the busbar, so that the busbar clamping edge can dig into the electrical conductor to be clamped over this height. However, it should be noted in this regard that the height must be limited, because otherwise the electrical conductor to be clamped can be damaged.

The distance of the contact surface of the depression behind the busbar clamping edge in the conductor insertion direction to a plane, parallel to the conductor insertion direction and running through the busbar clamping edge, can be greater than the distance of the busbar in the area of the contact of the spring clamping edge in front of the busbar clamping edge in the conductor insertion direction to a plane, parallel to the conductor insertion direction and running through the busbar clamping edge.

In this way, a busbar clamping edge can be provided, which can dig into the electrical conductor to be clamped over the greater distance. Such a design can be effected, for example, by means of a curvature in the busbar or by the formation of a thicker busbar in the area in front of the busbar clamping edge.

The spring-loaded terminal connection can have an insulating-material housing, wherein the insulating-material housing has at least one conductor insertion opening and a clamping spring. It is advantageous further if the insulating-material housing has at least two conductor insertion openings and at least two clamping springs, wherein the conductor insertion openings are located at diametrically opposite ends of the spring-loaded terminal connection.

It is conceivable that the two clamping springs are also made in one piece, wherein the clamping springs have a common contact arm, wherein the contact arm at the ends merges into a spring bend, which in turn extends into a clamping arm with a spring clamping edge. The spring-loaded terminal connection should therefore be designed such that two opposing electrical conductors can be electrically conductively contacted.

Further, the object is achieved by a method for producing the above-mentioned spring-loaded terminal connection, comprising the following steps: punching out the outer contour of the busbar; free cutting or punching out the busbar clamping section wherein the busbar clamping section protrudes from the plane of the metal sheet; bending the busbar contour; and/or forming the depression behind the busbar clamping section to form the clamping edge It has been shown that the production of a sharp clamping edge with a radius less than or equal to 0.2 mm can be achieved by first cutting or punching a busbar clamping section from the busbar and then forming the depression behind the busbar clamping edge to create a small radius. By forming the depression, the lateral edge areas of the busbar next to the busbar clamping section can advantageously be lowered compared to the busbar clamping section, so that the busbar clamping section with the now free-standing busbar clamping edge protrudes relative to the busbar surface. The forming (edging) thus leaves a sharp cutting edge.

A recess can also be formed in front of the busbar clamping edge. This method step can take place simultaneously with the forming of the depression or in a separate step after the depression is formed.

The indefinite article "a" ("an") is to be understood as such and not as a numeral. It is also conceivable that the spring-loaded terminal connection of the invention has a large number of conductor insertion openings, clamping springs, and busbars. It is thus possible for the spring-loaded terminal connection to have two busbars arranged next to one another, each with two clamping springs, so that a total of four electrical conductors can be clamped to the spring-loaded terminal connection. However, it is also possible that three, four, or five busbars arranged next to one another, each with two clamping springs, form a spring-loaded terminal connection of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
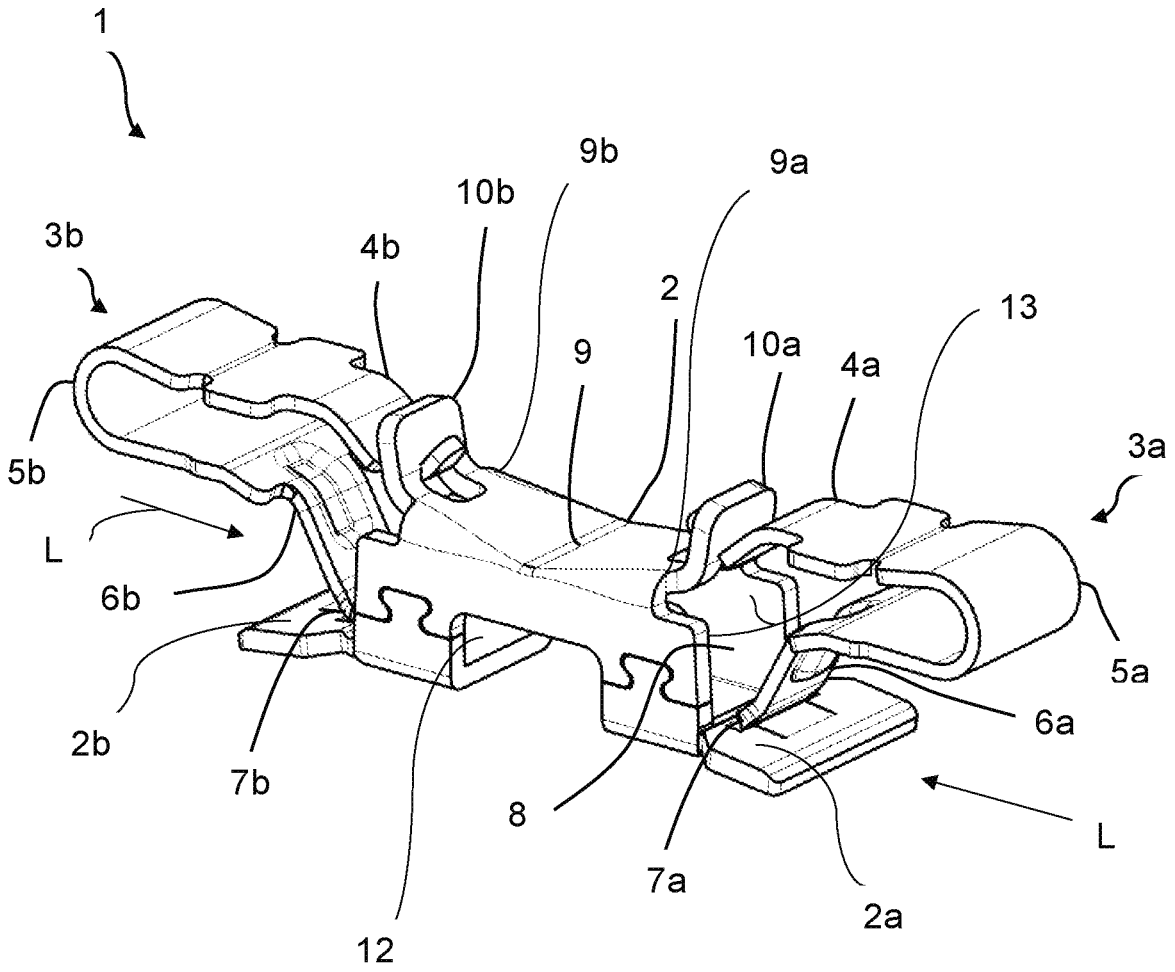
FIG. 1 shows an embodiment of a spring-loaded terminal connection in a perspective view.

FIG. 1 shows a spring-loaded terminal connection 1 in a perspective view in a first embodiment. Spring-loaded terminal connection 1 has a busbar 2, wherein a clamping spring 3*a*, 3*b* is located at each of the diametrically opposite ends of busbar 2. Clamping springs 3*a*, 3*b* each have a contact arm 4*a*, 4*b*, which merges into a spring bend 5*a*, 5*b* and extends into a clamping arm 6*a*, 6*b*. Clamping arm 6*a*, 6*b* here extends into a section of busbar 2, wherein clamping arm 6*a*, 6*b* has a spring clamping edge 7*a*, 7*b* and together with busbar 2 forms a clamping point for an electrical conductor to be clamped.

It can be seen that a conductor receiving section 8 for the electrical conductor to be clamped is located on each of the diametrically opposite ends of busbar 2. It becomes clear that conductor receiving sections 8 are designed closed circumferentially. Conductor receiving sections 8 have a top section 9*a*, 9*b* of a top surface 9, said section being associated with contact arm 4*a*, 4*b*, and a bottom section 12, associated with spring clamping edge 7*a*, 7*b*, wherein the respective top section 9*a*, 9*b* and bottom section 12 are connected to one another via two side surfaces 13 and form a continuous, circumferentially closed conductor receiving section 8.

Viewed in the respective conductor insertion direction L in front of conductor receiving sections 8*a*, 8*b*, busbar component 2 has a preferably integrally formed tab-shaped conductor contact section 2*a*, 2*b*, on which spring clamping edge 7*a*, 7*b* preferably rests in the closed state without an inserted electrical conductor. Conductor support sections 2*a*, 2*b* are preferably inclined relative to conductor insertion direction L and form a conductor insertion surface or a conductor insertion bevel.

It can be seen further that two tabs 10*a*, 10*b* are located on a top surface 9 of busbar 2, wherein tabs 10*a*, 10*b* are each located at the diametrically opposite ends of top surface 9. One of clamping springs 3*a*, 3*b* is in each case hooked into tabs 10*a*, 10*b* in a self-supporting manner, that is to say without additional fastening means.

However, it is also conceivable that clamping springs 3*a*, 3*b* are designed as a single clamping spring with two clamping arms 7*a*, 7*b*, wherein the individual clamping spring extends on top surface 9 of busbar 2.

Figure 2A:
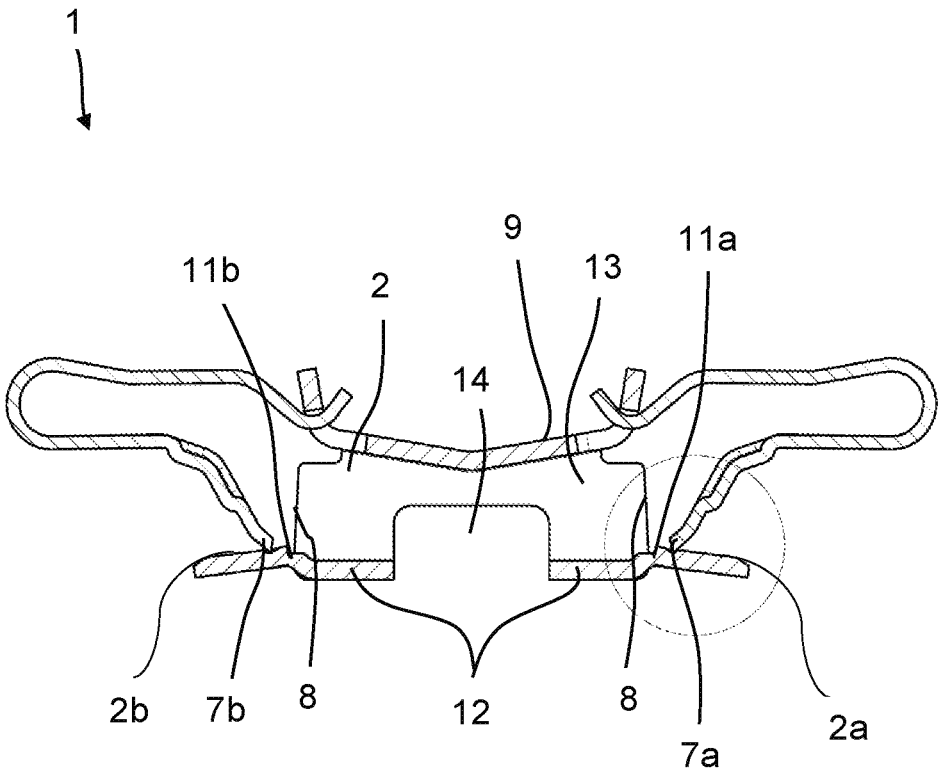
FIG. 2*a* shows a spring-loaded terminal connection according to FIG. 1 in a sectional side view without an inserted electrical conductor.

FIG. 2*a* shows a spring-loaded terminal connection 1 according to FIG. 1 in a sectional side view without an inserted electrical conductor. It can be seen that busbar 2 has a busbar clamping edge 11*a*, 11*b* in each case in the area of spring clamping edges 7*a*, 7*b*. Busbar clamping edges 11*a*, 11*b* can be provided in the area of conductor contact sections 2*a*, 2*b*. Busbar clamping edges 11*a*, 11*b* have a radius less than or equal to 0.2 mm, in particular a radius less than or equal to 0.1 mm. By forming the busbar clamping edge 11*a*, 11*b* with a very small radius, a spring-loaded terminal connection 1 is provided which has a large conductor retention force. Due to the formation of a small radius of busbar clamping edge 11*a*, 11*b*, busbar clamping edges 11*a*, 11*b* are formed so sharp that they can cut into an electrical conductor to be clamped and busbar clamping edge 11*a*, 11*b* thus digs into the electrical conductor to be clamped, wherein a suitable conductor retention force can be achieved.

However, it is also conceivable that busbar clamping edges 11*a*, 11*b* have even smaller radii. The effect of cutting into the electrical conductor is further improved thereby.

It can be seen that bottom section 12 of busbar 2 can form a support for the electrical conductors to be clamped. Bottom section 12 can include the tab-like conductor contact sections 2*a*, 2*b*. Bottom section 12 and top surface 9 are connected to one another via two opposing side surfaces 13. It becomes clear that bottom section 12 and side surfaces 13 have a cutout 14. It is clear further that top surface 9 is designed as a conductor insertion bevel, wherein top surface 9 is formed V-shaped. The cross section of conductor receiving sections 8 tapers towards the center of spring-loaded terminal connection 1 in this regard. In this way, an electrical conductor can be introduced into the larger cross section of conductor receiving sections 8, wherein the electrical conductor can be guided through the tapering cross section to the clamping point.

Figure 2B:
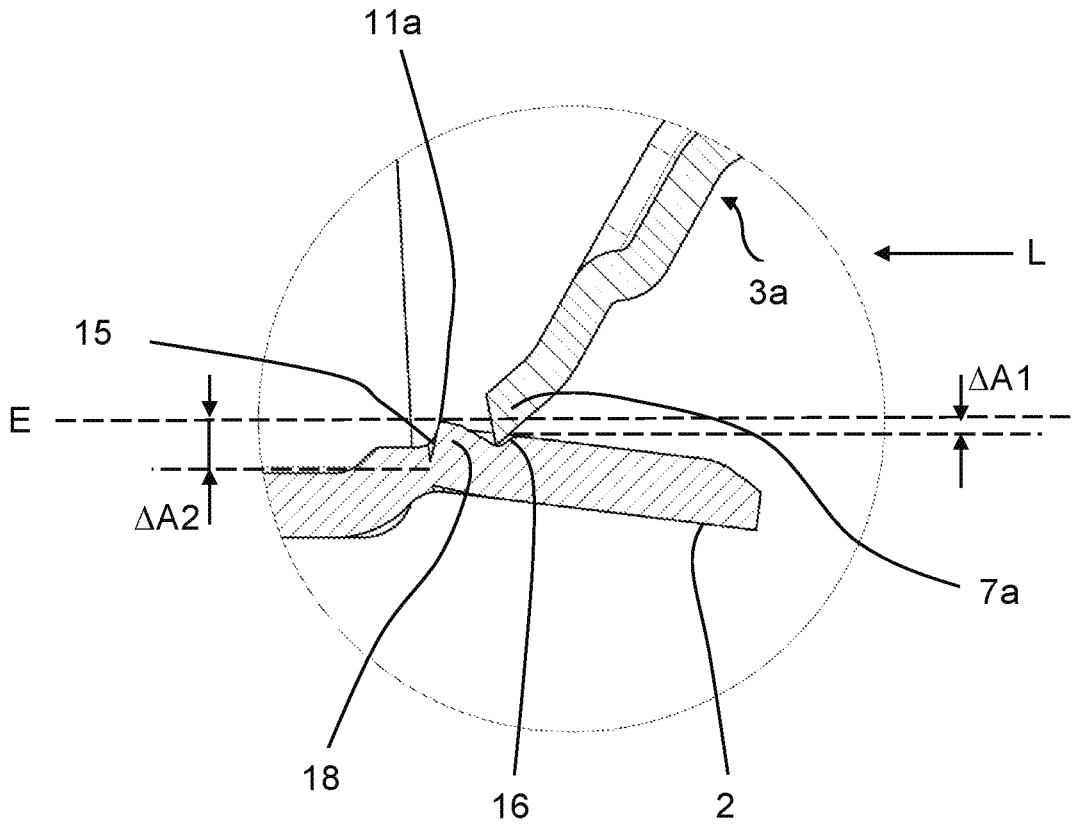
FIG. 2*b* shows an enlarged detail of a spring-loaded terminal connection according to FIG. 2*a;*

FIG. 2*b* shows an enlarged detail of spring-loaded terminal connection 1 according to FIG. 2*a*. In this case, the area around busbar clamping edge 11*a* is shown enlarged. It would be clear that busbar clamping edge 11*a* is located on a busbar clamping section 18. In this case, busbar clamping section 18 is cut or punched out of busbar 2.

It can be seen furthermore that busbar 2 has a depression 15 and a recess 16, wherein depression 15 is located behind busbar clamping edge 11*a* with respect to a conductor insertion direction L and recess 16 is located in front of busbar clamping edge 11*a* with respect to conductor insertion direction L. Recess 16 is designed such that it can accommodate spring clamping edge 7*a* when no electrical conductor is inserted in spring-loaded terminal connection 1. In this way, clamping spring 3*a* can be stabilized further, wherein the transport safety of spring-loaded terminal connection 1 can be increased.

As a result of depression 15, a busbar clamping edge 11*a* can be created at a sufficient height in relation to the busbar, so that busbar clamping edge 11*a* can dig into the electrical conductor to be clamped over this height. However, it has to be noted in this regard to limit the height, because otherwise the electrical conductor to be clamped can be damaged.

It is clear furthermore that the distance ΔA2 from a plane E, parallel to conductor insertion direction L and running through busbar clamping edge 11*a*, to busbar 2 behind busbar clamping edge 11*a* in conductor insertion direction L is greater than the distance ΔA1 in front of busbar clamping edge 11*a*. The contact surface of depression 15 is used as the reference point behind busbar clamping edge 11*a*. In conductor insertion direction L in front of busbar clamping edge 11*a*, the area in which spring clamping edge 7*a*, 7*b* rests on conductor contact section 2*a*, 2*b* is the reference point.

Figure 2C:
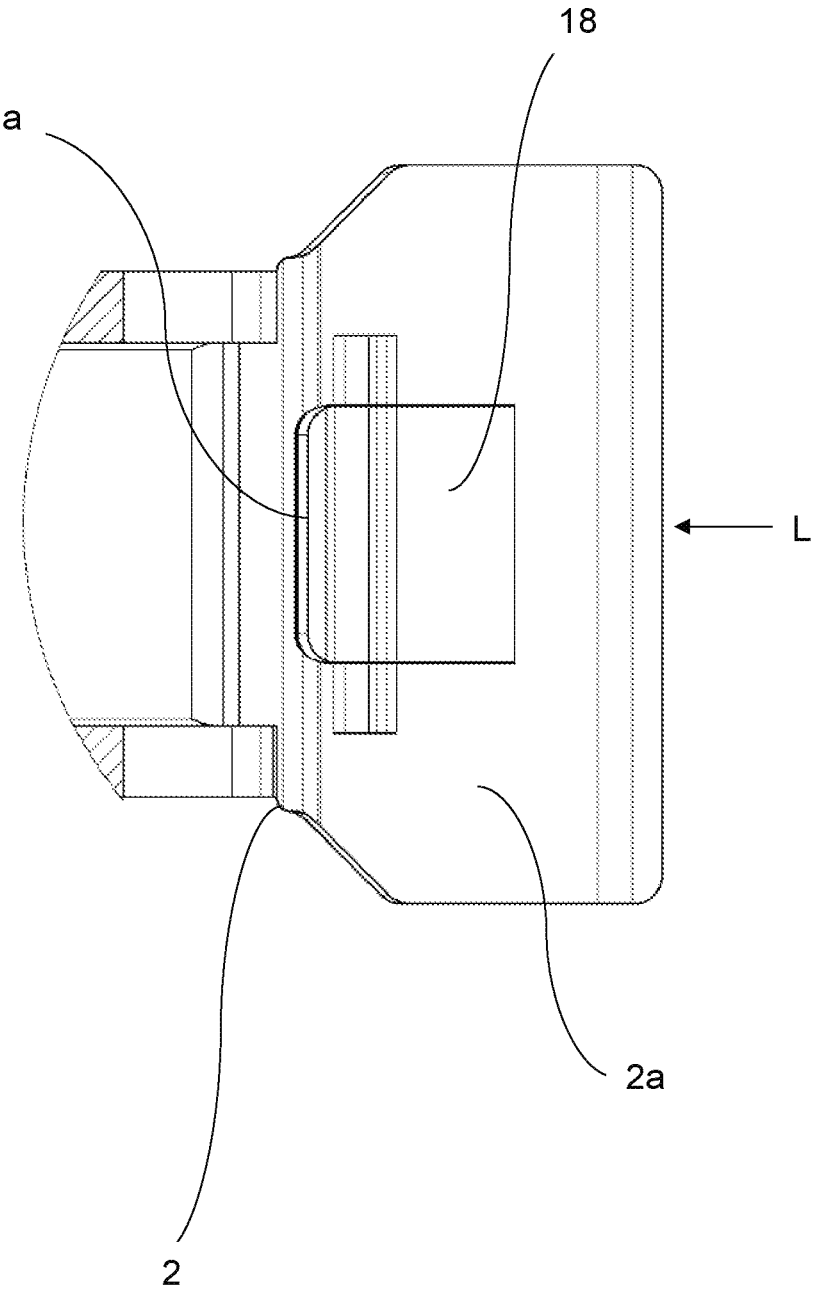
FIG. 2*c* shows an enlarged detail of a conductor contact section according to FIGS. 1 to 2*b* in a plan view.

FIG. 2*c* shows an enlarged detail of conductor contact section 2*a* according to FIGS. 1 to 2*b* in a plan view. It becomes clear that busbar clamping edge 11*a* is located on a protruding busbar clamping section 18. Busbar clamping section 18 is preferably punched out of the material of busbar 2, wherein busbar clamping section 18 protrudes from conductor contact section 2*a* of busbar 2 in a U-shape.

It can be seen furthermore that conductor rail clamping section 18 protrudes from busbar 2 in front of busbar clamping edge 11*a* in conductor insertion direction L.

Figure 3A:
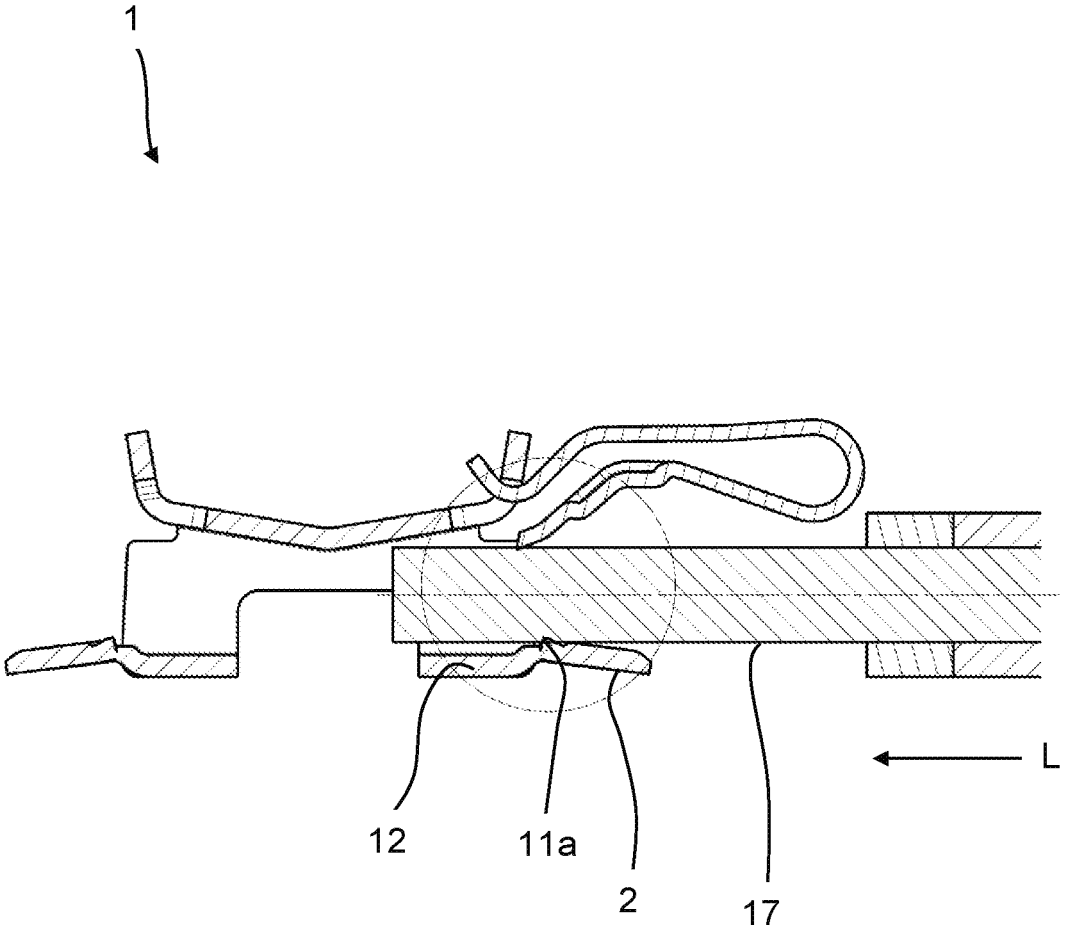
FIG. 3*a* shows a spring-loaded terminal connection according to FIGS. 1-2*b* in a sectional side view with an inserted electrical conductor.
Figure 3B:
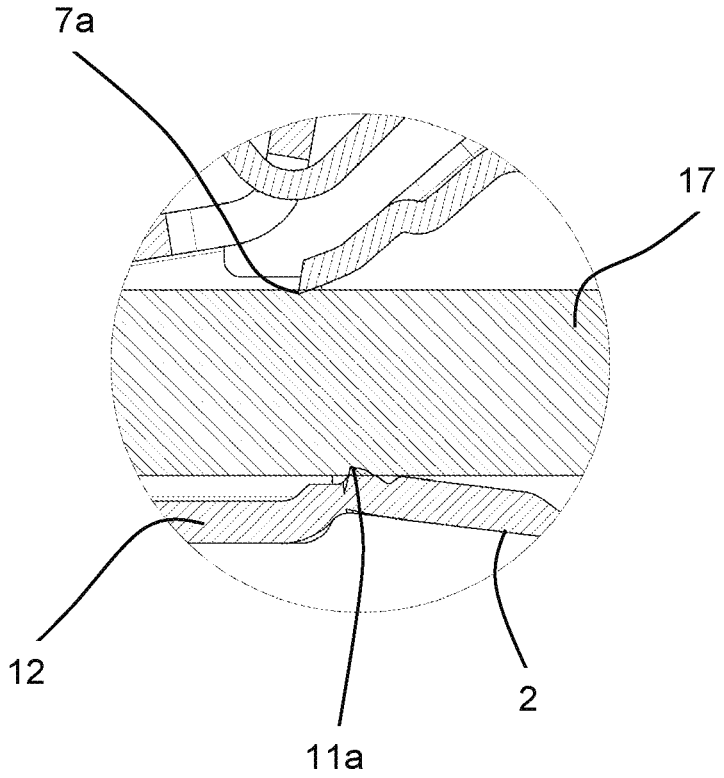
FIG. 3*b* shows an enlarged detail of a spring-loaded terminal connection according to FIG. 3*a*.

FIG. 3*a* shows a spring-loaded terminal connection 1 according to FIGS. 1-2*b* in a sectional side view with an inserted electrical conductor 17. FIG. 3*b* shows an enlarged detail of spring-loaded terminal connection 1 according to FIG. 3*a*. In this case, the area around busbar clamping edge 11*a* is shown enlarged.

It is clear that electrical conductor 17 is held clamped between spring clamping edge 7*a* and busbar clamping edge 11*a* on bottom section 12 of busbar 2. In this case, busbar clamping edge 11*a* is designed as a barb, wherein busbar clamping edge 11*a* cuts into electrical conductor 17, when electrical conductor 17 is pulled opposite to conductor insertion direction L, and thus digs into electrical conductor 17. In this way, a correspondingly high retention force can be exerted on electrical conductor 17, wherein electrical conductor 17 can be held fixed in the clamping point of spring-loaded terminal connection 1.

In this case, busbar clamping edge 11*a* can be designed to be more rigid than spring clamping edge 7*a*. The increased rigidity of busbar clamping edge 11*a* compared to clamping spring 7*a* ensures that busbar clamping edge 11*a* cuts into the electrical conductor to be clamped.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spring-loaded terminal connection comprising:

a busbar;

a clamping spring that has a clamping arm, the clamping arm extending towards the busbar and has a spring clamping edge to clamp an electrical conductor, wherein the busbar has a busbar clamping edge to fix the electrical conductor to be clamped, wherein the busbar clamping edge has a radius less than or equal to 0.2 mm, wherein the busbar clamping edge is arranged across the width of the busbar transversely to the electrical conductor to be clamped, wherein an end of the busbar has a conductor contact section that is inclined with respect to a conductor insertion direction, wherein a busbar clamping section is partially cut or punched out from the conductor contact section such that a free end of the busbar clamping section protrudes from the conductor contact section and another end of the busbar clamping section, opposite to the free end, is integral with the conductor contact section, and wherein the busbar clamping edge is located on the free end of the busbar clamping section.

2. The spring-loaded terminal connection according to claim 1, wherein the clamping spring has a contact arm and a spring bend located between the contact arm and the clamping arm.

3. The spring-loaded terminal connection according to claim 1, wherein the busbar clamping edge has a radius less than or equal to 0.1 mm.

4. The spring-loaded terminal connection according to claim 1, wherein the busbar clamping edge has an asymmetrical contour with respect to a plane of symmetry, and wherein the plane of symmetry extends through the busbar clamping edge orthogonally to the busbar.

5. The spring-loaded terminal connection according to claim 1, wherein the busbar clamping edge forms a barb for the electrical conductor to be clamped.

6. The spring-loaded terminal connection according to claim 1, wherein the busbar clamping edge is designed such that when the electrical conductor to be clamped is pulled, the busbar clamping edge cuts into the electrical conductor to be clamped.

7. The spring-loaded terminal connection according to claim 1, wherein the busbar clamping edge extends over only part of the width of the busbar, wherein a remaining part of the width of the busbar forms at least one busbar web.

8. The spring-loaded terminal connection according to claim 1, wherein the busbar clamping section is located on the busbar in front of the busbar clamping edge with respect to the conductor insertion direction.

9. The spring-loaded terminal connection according to claim 1, wherein the busbar has a tab for fastening the clamping spring, and wherein the clamping spring is adapted to be inserted into the tab in a self-supporting manner.

10. The spring-loaded terminal connection according to claim 1, wherein the busbar has a recess, and wherein the recess is designed to receive the spring clamping edge.

11. The spring-loaded terminal connection according to claim 10, wherein the recess is located in front of the busbar clamping edge with respect to the conductor insertion direction.

12. The spring-loaded terminal connection according to claim 1, wherein the busbar at least partially contains copper.

13. The spring-loaded terminal connection according to claim 1, wherein a depression is located in the area of the busbar clamping edge.

14. The spring-loaded terminal connection according to claim 13, wherein the depression is located behind the busbar clamping edge with respect to the conductor insertion direction.

15. The spring-loaded terminal connection according to claim 1, wherein a distance of a plane parallel to the conductor insertion direction and running through the busbar clamping edge to the busbar behind the busbar clamping edge in the conductor insertion direction is greater than a distance in front of the busbar clamping edge.

16. The spring-loaded terminal connection according to claim 1, wherein the spring-loaded terminal connection has an insulating material housing, wherein the insulating-material housing has at least one conductor insertion opening and a clamping spring.

17. The spring-loaded terminal connection according to claim 16, wherein the insulating-material housing has at least two conductor insertion openings and at least two clamping springs, wherein the conductor insertion openings are located at diametrically opposite ends of the spring-loaded terminal connection.

18. A method for producing the spring-loaded terminal connection according to claim 1, the method comprising:

punching out an outer contour of the busbar utilizing a metal sheet;

free cutting or punching out the busbar clamping section from the conductor contact section, such that the free end of the busbar clamping section protrudes from a plane of the conductor contact section;

bending the outer contour of the busbar; and forming a depression behind the busbar clamping section with respect to the conductor insertion direction to form the busbar clamping edge.

19. The method according to claim 18, further comprising:

forming a recess in front of the busbar clamping edge with respect to the conductor insertion direction.

* * * * *